US012371962B2

(12) United States Patent
Stach et al.

(10) Patent No.: US 12,371,962 B2
(45) Date of Patent: Jul. 29, 2025

(54) DEBRIS EXCLUSION TOOL, SYSTEM AND METHOD

(71) Applicant: Evolution Completions, Inc., Williston, ND (US)

(72) Inventors: John G. Stach, Williston, ND (US); Garvin H. Leintz, Sydney, MT (US); Alan M. Roness, Williston, ND (US)

(73) Assignee: Evolution Completions, Inc., Williston, ND (US)

( * ) Notice: Subject to any disclaimer, the term of this patent is extended or adjusted under 35 U.S.C. 154(b) by 0 days.

(21) Appl. No.: 18/422,414

(22) Filed: Jan. 25, 2024

(65) Prior Publication Data

US 2024/0418049 A1 Dec. 19, 2024

Related U.S. Application Data

(60) Provisional application No. 63/508,839, filed on Jun. 16, 2023.

(51) Int. Cl.
*E21B 27/00* (2006.01)
*E21B 33/12* (2006.01)

(52) U.S. Cl.
CPC ..... *E21B 27/00* (2013.01); *E21B 33/12* (2013.01); *E21B 2200/08* (2020.05)

(58) Field of Classification Search
CPC ..... E21B 27/00; E21B 33/12; E21B 2200/08
See application file for complete search history.

(56) References Cited

U.S. PATENT DOCUMENTS

| | | | | |
|---|---|---|---|---|
| 8,651,184 | B2 | 2/2014 | Raglin | |
| 9,309,735 | B2 | 4/2016 | Anyan | |
| 9,441,435 | B2 | 9/2016 | Leitch | |
| 10,030,485 | B2 | 7/2018 | Gourmelon | |
| 10,082,014 | B2 | 9/2018 | Fielder, III et al. | |
| 11,525,348 | B2 | 12/2022 | Xiao et al. | |
| 11,572,760 | B2 | 2/2023 | Brown et al. | |
| 11,613,982 | B2 | 3/2023 | Laing et al. | |
| 2017/0328190 | A1* | 11/2017 | Fielder, III | E21B 34/08 |
| 2019/0144733 | A1* | 5/2019 | Fripp | E21B 33/128 166/387 |
| 2022/0341279 | A1* | 10/2022 | McFarlin | E21B 34/063 |
| 2022/0389805 | A1 | 12/2022 | Marshall | |

FOREIGN PATENT DOCUMENTS

| | | | | |
|---|---|---|---|---|
| WO | WO-2023131805 | A1 * | 7/2023 | E21B 33/134 |

* cited by examiner

*Primary Examiner* — Caroline N Butcher
(74) *Attorney, Agent, or Firm* — Abel Schillinger, LLP

(57) ABSTRACT

A debris exclusion tool can include a debris exclusion plug, and a tube having opposite ends, the debris exclusion plug being releasably secured at one tube end and preventing debris from falling into the tube end, and the other tube end being securable in a tubular string in a well below the first end. A method of establishing fluid communication through a tubular string can include blocking a an end of a tube with a debris exclusion plug, and positioning the tube within the tubular string, an opposite end of the tube being positioned below the first end, and an annulus being formed between the tube and the tubular string.

20 Claims, 5 Drawing Sheets

DEBRIS EXCLUSION TOOL, SYSTEM AND METHOD

CROSS-REFERENCE TO RELATED APPLICATION

This application claims the benefit of the filing date of U.S. provisional application No. 63/508,839 filed on 16 Jun. 2023. The entire disclosure of the prior application is incorporated herein by this reference for all purposes.

BACKGROUND

This disclosure relates generally to equipment utilized and operations performed in conjunction with a subterranean well and, in an example described below, more particularly provides a debris exclusion tool, system and method.

Referring to FIG. 1, it is sometimes advantageous to install a tubing string 10 in a well, with a distal end of the tubing string sealed off. A pump-out plug 12 secured in the end of the tubing string 10 with shear pins 14 may be used for this purpose. A production packer 16 may be used to seal off an annulus 18 formed between the tubing string 10 and a wellbore 20, which may be lined with casing 22 and cement 24.

Various purposes may be served by including the pump-out plug 12 in the tubing string 10. For example, it may be desired to pressure test the tubing string 10 before placing the well in production. After the tubing string 10 has been pressure tested, pressure in the tubing string can be increased, in order to shear the shear pins 14 and displace the pump-out plug 12 out of the tubing string.

It will be appreciated that improvements are continually needed in the art of conducting well operations. This disclosure provides such improvements to the art. The improvements may be used in a wide variety of different well operations, including but not limited to operations in which a tubing string is pressure tested and operations in which a pump-out plug is displaced from an end of the tubing string, although the principles of this disclosure are not necessarily used with such operations.

DETAILED DESCRIPTION

The present inventors have recognized that debris 26 can accumulate in the interior of the tubing string 10 at or near its distal end in the well. This accumulated debris 26 can possibly prevent transmission of increased pressure (for example, applied to the interior of the tubular string at the surface) to the pump-out plug 12. In this circumstance, it will be impossible or very difficult to discharge the pump-out plug 12 from the distal end of the tubing string without first removing the debris 26 (which is expensive and time-consuming).

In order to prevent the accumulation of debris in a tubular string from preventing a pump-out plug from being discharged from the tubular string, the present inventors have devised certain improvements described more fully below. Additional improvements may be used in circumstances where it is not desired to discharge a pump-out plug from a tubular string.

Figure 1:
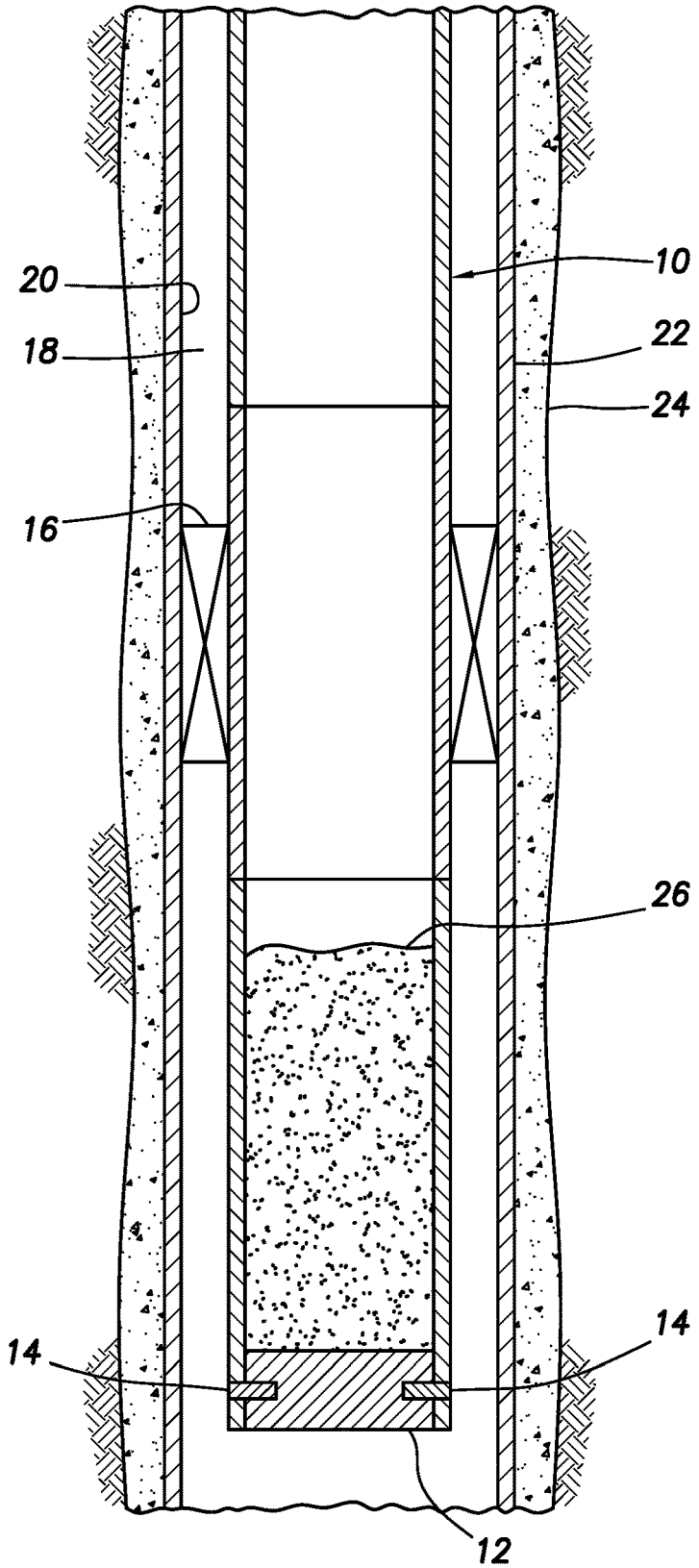
FIG. 1 (PRIOR ART)
FIG. 1 is a representative cross-sectional view of a prior art well system and associated method.
Figure 2:
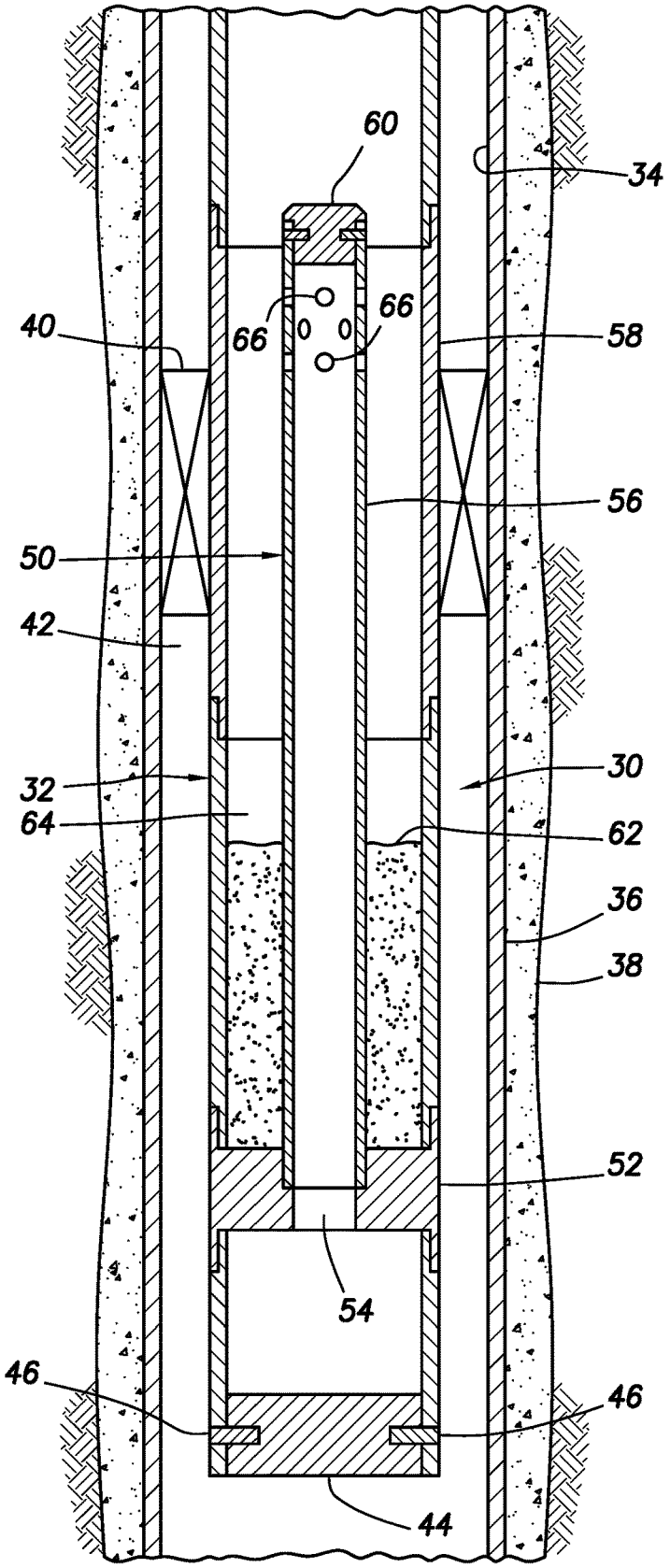
FIG. 2 is a representative cross-sectional view of an example of a well system and associated method which can embody the principles of this disclosure.

Representatively illustrated in FIG. 2 is a system 30 for use with a subterranean well, and an associated method, which can embody principles of this disclosure. However, it should be clearly understood that the system 30 and method are merely one example of an application of the principles of this disclosure in practice, and a wide variety of other examples are possible. Therefore, the scope of this disclosure is not limited at all to the details of the system 30 and method described herein and/or depicted in the drawings.

In the FIG. 2 example, a tubular string 32 is positioned in a wellbore 34. The wellbore 34 is lined with casing 36 and cement 38, but in other examples the tubular string 32 could be positioned in an uncased or open hole section of the wellbore 34. As depicted in FIG. 2, the wellbore 34 is vertical, but in other examples the wellbore could be inclined or deviated from vertical.

The tubular string 32 includes a packer 40 that seals off an annulus 42 formed between the tubular string 32 and the wellbore 34. A pump-out plug 44 is releasably secured in a distal end of the tubular string 32 with shear pins, shear screws or another type of releasable retainer 46. The pump-out plug 44 can be discharged from the distal end of the tubular string 32 if a predetermined pressure differential is applied from an interior of the tubular string to the wellbore 34.

In some examples, the pump-out plug 44 can be in the form of a ceramic burst disc, or another form of frangible barrier. Increased pressure applied in the tubular string 32 will cause the frangible barrier to break or burst, thereby opening the distal end of the tubular string. Thus, the term "pump-out plug" as used herein includes any form of releasable plug or barrier that selectively blocks fluid flow through a tubular string.

In some examples, the tubular string 32 may not extend uphole from the packer 40 (such as, from the packer to the surface). For example, if an electric submersible pump is used to pump produced fluids to the surface, the fluids can be pumped through the casing 36 above the packer 40. In these cases, pressure can still be applied to the interior of the tubular string 32 below the packer 40 by applying the increased pressure to the casing 36 at the surface to discharge the pump-out plug 44 (or other type of releasable barrier).

In order to ensure that increased pressure applied to the interior of the tubular string 32 (for example, from the surface) will be communicated to the pump-out plug 44, the system 30 includes a debris exclusion tool 50 connected in the tubular string 32. The debris exclusion tool 50 includes a coupling 52 connected as part of the tubular string 32 above the pump-out plug 44. A flow passage 54 extends axially through the coupling 52.

The flow passage 54 is in communication with an interior of a tube 56 extending upwardly from the coupling 52. In this example, a lower end of the tube 56 is secured to the coupling 52 and an upper end of the tube extends upwardly into the packer 40. As depicted in FIG. 2, the upper end of the tube 56 extends to an upper end of an inner mandrel 58 of the packer 40.

The upper end of the tube 56 is closed off with a debris exclusion plug 60. The debris exclusion plug 60 prevents debris 62 from falling into the interior of the tube 56. Instead, any debris 62 that falls inside the tubular string 32 will be diverted to an annulus 64 formed between the tube 56 and the tubular string 32.

The debris 62 will accumulate in the annulus 64, without affecting an ability of increased pressure applied to the interior of the tubular string 32 to be transmitted to the pump-out plug 44 via the flow passage 54. The coupling 52 blocks a lower end of the annulus 64, so that the debris 62 cannot pass into the tubular string 32 below the coupling.

In the FIG. 2 example, ports 66 are formed through a sidewall of the tube 56 below the debris exclusion plug 60. The ports 66 provide fluid communication between an interior and an exterior of the tube 56. Thus, increased pressure applied to the interior of the tubular string 32 will be communicated through the ports 66 to the interior of the tube 56, and through the flow passage 54 to the pump-out plug 44. In other examples, the ports 66 could be formed in another component (such as, the debris exclusion plug 60 or a collar 68 (see FIG. 3)).

In some examples, the tubular string 32 may not extend uphole from the packer 40 (such as, from the packer to the surface). For example, if an electric submersible pump is used to pump produced fluids to the surface, the fluids can be pumped through the casing 36 above the packer 40. In these cases, pressure can still be applied to the interior of the tubular string 32 below the packer 40 by applying the increased pressure to the casing 36 at the surface to discharge the pump-out plug 44 (or other type of releasable barrier).

Figure 3:
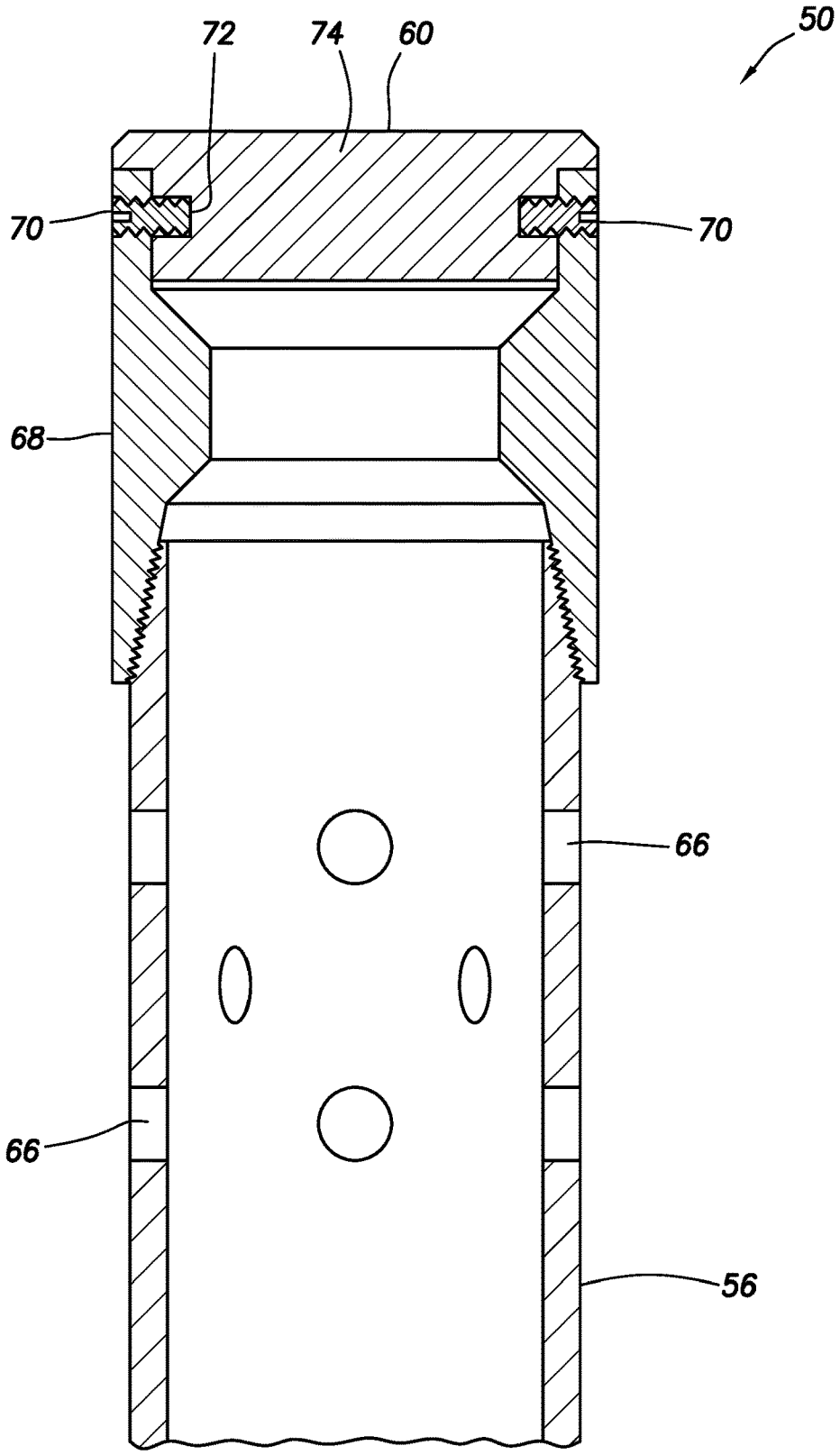
FIG. 3 is a representative cross-sectional view of an example of a debris exclusion tool that may be used in the FIG. 2 system and method.

Referring additionally now to FIG. 3, a cross-sectional view of an example of the debris exclusion tool 50 is representatively illustrated. Only an upper end portion of the debris exclusion tool 50 is depicted in FIG. 3.

In the FIG. 3 example, the upper end of the tube 56 is threaded into a collar 68. The debris exclusion plug 60 is received in an upper end of the collar 68. The debris exclusion plug 60 is secured in the collar 68 with fasteners 70, which are threaded through the upper end of the collar and into an annular groove 72 formed in the debris exclusion plug.

In some examples, the debris exclusion plug 60 can be made of a dissolvable or otherwise degradable material 74. In this manner, the upper end of the tube 56 can eventually be unblocked, for example, to provide a larger flow area for production, or to provide for physical access to the wellbore 34 below the tubular string 32 (see FIG. 2) after the pump-out plug 44 has been discharged from the tubular string.

The degradable material 74 may dissolve in well fluid after a predetermined amount of time. Alternatively, the degradable material 74 could corrode, melt or otherwise degrade in response to contact with a certain fluid pH range, temperature, etc. The scope of this disclosure is not limited to use of any particular type of degradable material.

Figure 4:
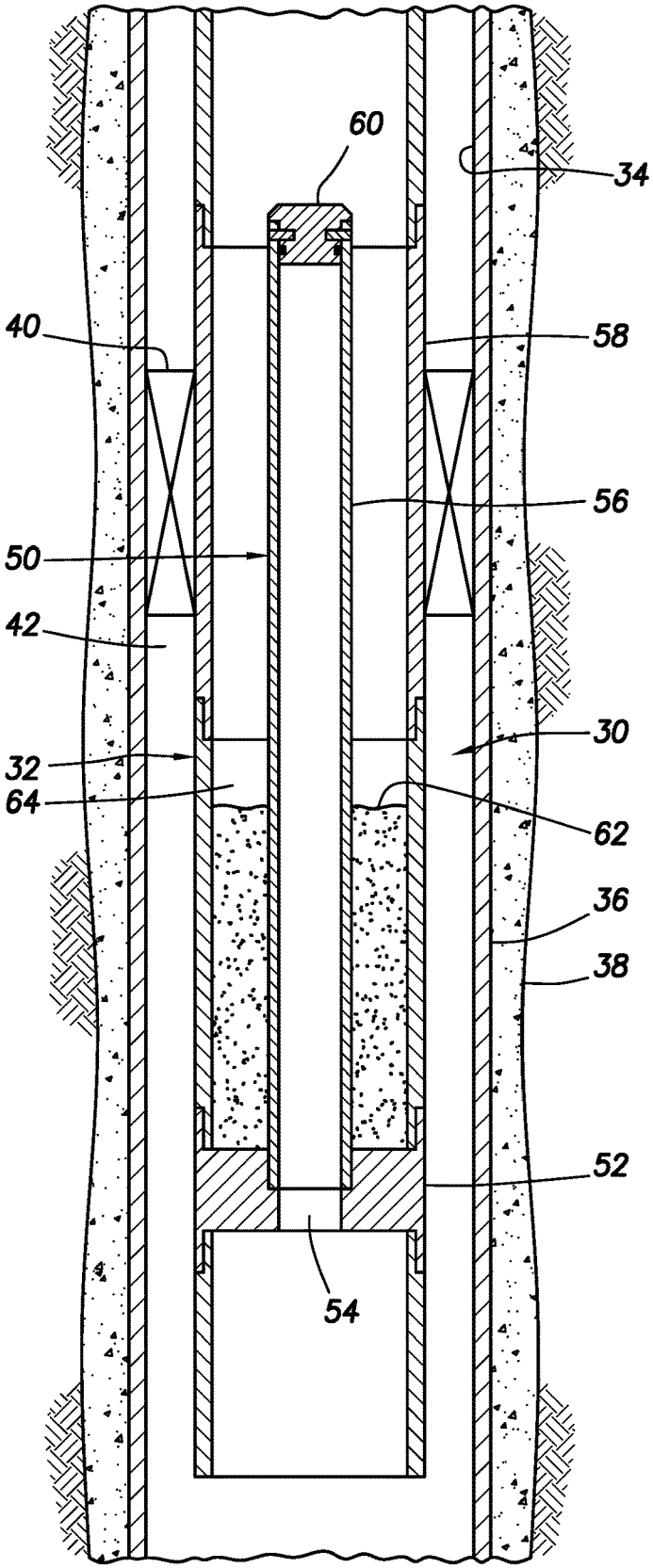
FIG. 4 is a representative cross-sectional view of another example of the well system and method.

Referring additionally now to FIG. 4, a cross-sectional view of another example of the debris exclusion tool 50 in the system 30 is representatively illustrated. Components of the FIG. 4 system 30 that are the same as, or similar to, those of the FIG. 2 system 30 are indicated in FIG. 4 using the same reference numerals.

In the FIG. 4 example, the distal end of the tubular string 32 is not blocked by the pump-out plug 44. Instead, the debris exclusion tool 50 prevents fluid communication through the tubular string 32 below the packer 40. The debris exclusion plug 60 seals off the upper end of the tube 56, and the ports 66 are not provided through the sidewall of the tube. Thus, initially there is no fluid communication between the interior and the exterior of the tube 56.

When it is desired to establish fluid communication between the interior and the exterior of the tube 56 (for example, to place the well in production), a predetermined pressure differential can be applied from the interior to the exterior of the tube 56 to discharge the debris exclusion plug 60 from the upper end of the tube. Alternatively, the debris exclusion plug 60 may dissolve or otherwise degrade to unblock the upper end of the tube 56.

To apply the predetermined pressure differential from the interior to the exterior of the tube 56, pressure can be allowed to build up in the wellbore 34 below the packer 40. For example, pressure from an earth formation penetrated by the wellbore 34 can be communicated to the wellbore via perforations (not shown) formed through the casing 36 and cement 38. Alternatively, pressure in the interior of the tubular string 32 above the debris exclusion plug 60 can be reduced. The scope of this disclosure is not limited to any particular manner of applying the predetermined pressure differential across the debris exclusion plug 60 or from the interior to the exterior of the tube 56.

When the predetermined pressure differential is applied across the debris exclusion plug 60, shear pins, shear screws, a snap ring or another type of releasable member that previously secured the debris exclusion plug in the upper end of the tube 56 will shear or otherwise release, thereby allowing the debris exclusion plug to be discharged from the upper end of the tube. The debris exclusion plug 60 will then no longer block the upper end of the tube 56, and fluid communication and physical access will be provided to the wellbore 34 below the debris exclusion tool 50 via the interior of the tube.

Figure 5:
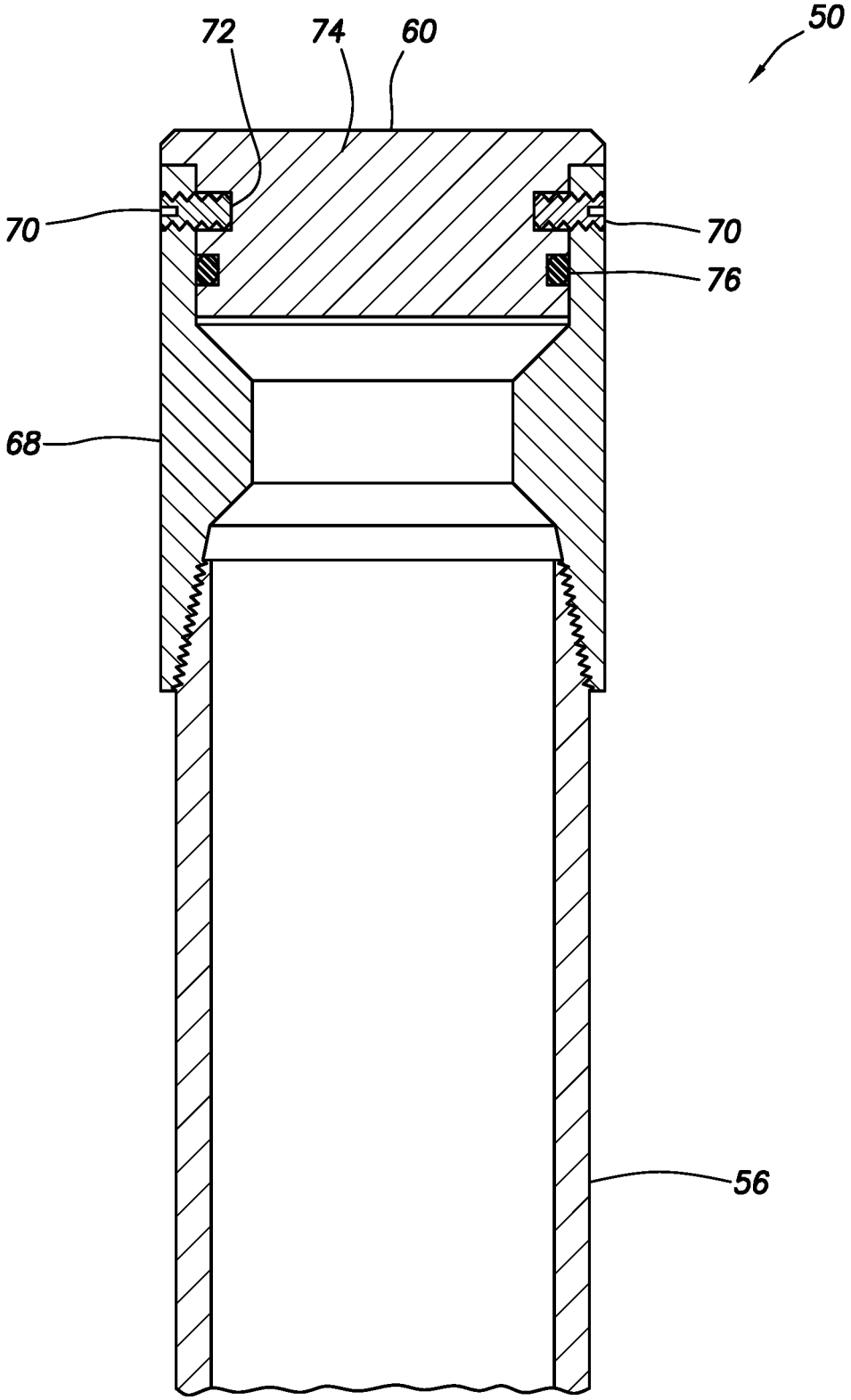
FIG. 5 is a representative cross-sectional view of another example of the debris exclusion tool that may be used in the FIG. 4 system and method.

Referring additionally now to FIG. 5, a cross-sectional view of another example of the debris exclusion tool 50 is representatively illustrated. This example of the debris exclusion tool 50 may be used with the FIG. 4 system 30 example. Only an upper end portion of the debris exclusion tool 50 is depicted in FIG. 5.

In the FIG. 5 example, the debris exclusion plug 60 is releasably secured in the collar 68 by the fasteners 70, which may comprise shear pins, shear screws, a snap ring, collets or other type of releasable devices. An annular seal 76 seals between the debris exclusion plug 60 and the collar 68.

A predetermined pressure differential applied across the debris exclusion plug 60 (i.e., from the interior to the exterior of the tube 56) will cause the fasteners 70 to shear or otherwise release. The debris exclusion plug 60 will then be discharged from the collar 68 at the upper end of the tube 56. Alternatively, the debris exclusion plug 60 may dissolve or otherwise degrade as described above for the FIG. 3 example.

In the FIGS. 2 & 4 examples, only a single tube 56 is depicted in the drawings. It will be appreciated, however, that the tube 56 can comprise any number of individual sections connected together to form the tube. Thus, as used herein, the term "tube" can include a segmented or a continuous tubular structure made up of multiple or a single component, respectively. The collar 68 may be considered a part of the tube 56.

It may now be fully appreciated that the above disclosure provides to the art a variety of improvements that may be useful for certain well operations. In examples described above, the debris exclusion plug 60 prevents debris 62 from interfering with well operations.

The above disclosure provides to the art a debris exclusion tool 50 for use in a subterranean well. In one example, the debris exclusion tool 50 comprises a debris exclusion plug 60, and a tube 56 having first and second opposite ends. The debris exclusion plug 60 is releasably secured at the tube 56 first end and prevents debris 62 from falling into the tube 56 first end. The tube 56 second end is configured to secure in a tubular string 32 in the well with the second end being below the first end.

The debris exclusion tool 50 may include a port 66 that provides fluid communication between an interior and an exterior of the tube 56. The port 66 may be formed through a sidewall of the tube 56.

Fluid communication between an interior and an exterior of the tube 56 may be prevented by the debris exclusion plug 60. The debris exclusion plug 60 may be configured to release from the first end of the tube 56 and permit fluid communication between the interior and the exterior of the tube 56 in response to a predetermined pressure differential from the interior to the exterior of the tube 56.

The debris exclusion plug 60 may comprise a degradable material 74. The degradable material 74 may be configured to degrade in a predetermined amount of time in a well environment. The debris exclusion plug 60 may be configured to dissolve in well fluid.

The debris exclusion tool 50 may include a coupling 52 configured for connection as part of a tubular string 32. The coupling 52 may include a flow passage 54 extending axially through the coupling 52. The tube 56 may be secured to the coupling 52 with the flow passage 54 in fluid communication with an interior of the tube 56.

Also provided to the art by the above disclosure is a method of establishing fluid communication through a tubular string 32 in a subterranean well. In one example, the method can include: blocking a first end of a tube 56 with a debris exclusion plug 60; and positioning the tube 56 within the tubular string 32. A second end of the tube 56 is positioned below the first end, and an annulus 64 is formed between the tube 56 and the tubular string 32.

The method may include providing fluid communication between an interior and an exterior of the tube 56 via at least one port 66. The method may include forming the port 66 through a sidewall of the tube 56.

The positioning step may include securing the second end in the tubular string 32 above a pump-out plug 44 that blocks fluid flow through a distal end of the tubular string 56. The method may include applying increased pressure through an interior of the tube 56, thereby discharging the pump-out plug 44 from the distal end of the tubular string 32.

The positioning step may include connecting the second end to a coupling 52 connected in the tubular string 32. A flow passage 54 may extend axially through the coupling 52. The connecting step may include providing fluid communication between the flow passage 54 and an interior of the tube 56.

The method may include applying a predetermined pressure differential from an interior to an exterior of the tube 56, thereby discharging the debris exclusion plug 60 from the first end of the tube 56. The method may include the debris exclusion plug 50 degrading or dissolving in the well.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A debris exclusion tool for use in a subterranean well, the debris exclusion tool comprising:

a debris exclusion plug; and a tube having first and second opposite ends, the debris exclusion plug being releasably secured at the tube first end and preventing debris from falling into the tube first end, and the tube second end being configured to secure in a tubular string in the well with the second end being below the first end, and the second end being disposed in the tubular string above a pump-out plug that is configured to block fluid flow through a distal end of the tubular string.

2. The debris exclusion tool of claim 1, further comprising a port that provides fluid communication between an interior and an exterior of the tube.

3. The debris exclusion tool of claim 2, in which the port is formed through a sidewall of the tube.

4. The debris exclusion tool of claim 1, in which fluid communication between an interior and an exterior of the tubular string is prevented by the pump-out plug.

5. The debris exclusion tool of claim 4, in which the pump-out plug is configured to release from the distal end of the tubular string and permit fluid flow through the distal end in response to a predetermined pressure differential from the interior to the exterior of the tubular string.

6. The debris exclusion tool of claim 1, in which the debris exclusion plug comprises a degradable material.

7. The debris exclusion tool of claim 6, in which the degradable material is configured to degrade in a predetermined amount of time in a well environment.

8. The debris exclusion tool of claim 1, in which the debris exclusion plug is configured to dissolve in well fluid.

9. The debris exclusion tool of claim 1, further comprising a coupling configured for connection as part of a tubular string, the coupling including a flow passage extending axially through the coupling.

10. The debris exclusion tool of claim 9, in which the tube is secured to the coupling with the flow passage in fluid communication with an interior of the tube.

11. A method of establishing fluid communication through a tubular string in a subterranean well, the method comprising:

blocking a first end of a tube with a debris exclusion plug; and positioning the tube within the tubular string above a pump-out plug that is configured to block fluid flow through a distal end of the tubular string, a second end of the tube being positioned below the first end, and an annulus being formed between the tube and the tubular string.

12. The method of claim 11, further comprising providing fluid communication between an interior and an exterior of the tube via at least one port.

13. The method of claim 12, further comprising forming the port through a sidewall of the tube.

14. The method of claim 11, in which the positioning comprises securing the second end in the tubular string above the the pump-out plug.

15. The method of claim 14, further comprising applying increased pressure through an interior of the tube, thereby discharging the pump-out plug from the distal end of the tubular string.

16. The method of claim 11, in which the positioning comprises connecting the second end to a coupling connected in the tubular string.

17. The method of claim 16, in which a flow passage extends axially through the coupling, and in which the connecting comprises providing fluid communication between the flow passage and an interior of the tube.

18. The method of claim 11, further comprising applying a predetermined pressure differential from an interior to an exterior of the tube, thereby discharging the debris exclusion plug from the first end of the tube.

19. The method of claim 11, further comprising the debris exclusion plug degrading in the well.

20. The method of claim 11, further comprising the debris exclusion plug dissolving in the well.

* * * * *